US008181805B2

(12) United States Patent
Barker et al.

(10) Patent No.: US 8,181,805 B2
(45) Date of Patent: May 22, 2012

(54) HOT FILL CONTAINER

(75) Inventors: Steven P. Barker, Brooklyn, MI (US); Bradley W. Caszatt, Manchester, MI (US)

(73) Assignee: Amcor Limited, Hawthorn, Victoria (AU)

( * ) Notice: Subject to any disclaimer, the term of this patent is extended or adjusted under 35 U.S.C. 154(b) by 831 days.

(21) Appl. No.: 12/201,395

(22) Filed: Aug. 29, 2008

(65) Prior Publication Data

US 2009/0057263 A1 Mar. 5, 2009

Related U.S. Application Data

(60) Provisional application No. 60/967,119, filed on Aug. 31, 2007.

(51) Int. Cl.
*B65D 1/02* (2006.01)
*B65D 1/40* (2006.01)

(52) U.S. Cl. ..... 215/381; 215/382; 220/675

(58) Field of Classification Search ..... 215/379–384; 220/669, 675

See application file for complete search history.

(56) References Cited

U.S. PATENT DOCUMENTS

| | | | | |
|---|---|---|---|---|
| 5,054,632 | A * | 10/1991 | Alberghini et al. | 215/381 |
| 5,381,910 | A * | 1/1995 | Sugiura et al. | 215/398 |
| 5,762,221 | A * | 6/1998 | Tobias et al. | 215/381 |
| 6,016,932 | A * | 1/2000 | Gaydosh et al. | 215/382 |
| 2002/0000421 | A1 * | 1/2002 | Ota et al. | 215/381 |
| 2003/0015491 | A1 * | 1/2003 | Melrose et al. | 215/381 |
| 2003/0168425 | A1 * | 9/2003 | Yourist | 215/381 |
| 2005/0269284 | A1 * | 12/2005 | Pedmo et al. | 215/381 |
| 2006/0108317 | A1 * | 5/2006 | Tanaka et al. | 215/382 |
| 2006/0131258 | A1 * | 6/2006 | Yourist | 215/381 |
| 2007/0075031 | A1 * | 4/2007 | Tanaka et al. | 215/382 |
| 2008/0041812 | A1 * | 2/2008 | Stowitts | 215/384 |
| 2009/0014407 | A1 * | 1/2009 | Strasser et al. | 215/381 |

* cited by examiner

*Primary Examiner* — Sue Weaver
(74) *Attorney, Agent, or Firm* — Harness, Dickey & Pierce, P.L.C.

(57) ABSTRACT

The plastic container according to the present disclosure is an aesthetically pleasing plastic container suitable for premium hot fill beverages, such as teas and fruit juices. The plastic container defines a body and includes an upper portion having a finish. Integrally formed with the finish and extending downward therefrom is a shoulder region. The shoulder region merges into and provides a transition between the finish and a first vacuum absorbing region. The first vacuum absorbing region merges into a waist region. The waist region merges into a second vacuum absorbing region. The second vacuum absorbing region transitions into a base portion having a base.

17 Claims, 3 Drawing Sheets

HOT FILL CONTAINER

CROSS-REFERENCE TO RELATED APPLICATIONS

This application claims the benefit of U.S. Provisional Application No. 60/967,119, filed on Aug. 31, 2007. The entire disclosure of the above application is incorporated herein by reference.

TECHNICAL FIELD

This disclosure generally relates to plastic containers for retaining a commodity, and in particular a liquid commodity. More specifically, this disclosure relates to a plastic container that is aesthetically pleasing and suitable for premium hot fill beverages, such as teas and fruit juices.

BACKGROUND

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

After being hot-filled, the heat-set containers may be capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-380 mm Hg less than atmospheric pressure (i.e., 759 mm Hg-380 mm Hg). If not controlled or otherwise accommodated, these vacuum pressures result in deformation of the container, which leads to either an aesthetically unacceptable container or one that is unstable. Hot-fillable plastic containers must provide sufficient flexure to compensate for the changes of pressure and temperature, while maintaining structural integrity and aesthetic appearance. Typically, the industry accommodates vacuum related pressures with sidewall structures or vacuum panels formed within the sidewall of the container. Such vacuum panels generally distort inwardly under vacuum pressures in a controlled manner to eliminate undesirable deformation.

While such vacuum panels allow containers to withstand the rigors of a hot-fill procedure, the panels have limitations and drawbacks. First, such panels formed within the sidewall of a container do not create a generally smooth glass-like appearance. Second, packagers often apply a wrap-around or sleeve label to the container over these panels. The appearance of these labels over the vacuum panels is such that the label often becomes wrinkled and not smooth. Additionally, one grasping the container generally feels the vacuum panels beneath the label and often pushes the label into various panel crevasses and recesses.

SUMMARY

The plastic container according to the present disclosure is an aesthetically pleasing plastic container suitable for premium hot fill beverages, such as teas and fruit juices. The plastic container defines a body and includes an upper portion having a finish. Integrally formed with the finish and extending downward therefrom is a shoulder region. The shoulder region merges into and provides a transition between the finish and a first vacuum absorbing region. The first vacuum absorbing region merges into a waist region. The waist region merges into a second vacuum absorbing region. The second vacuum absorbing region can transition into a base portion having a base. A neck may also be included having an extremely short height, that is, becoming a short extension from the finish, or an elongated height, extending between the finish and the shoulder region.

The plastic container has been designed to retain a commodity. The commodity may be in any form such as a solid or liquid product. In one example, a liquid commodity may be introduced into the plastic container during a thermal process, typically a hot-fill process, such as described above. In another example, the commodity may be introduced into the plastic container under ambient temperatures.

DETAILED DESCRIPTION

Figure 1:
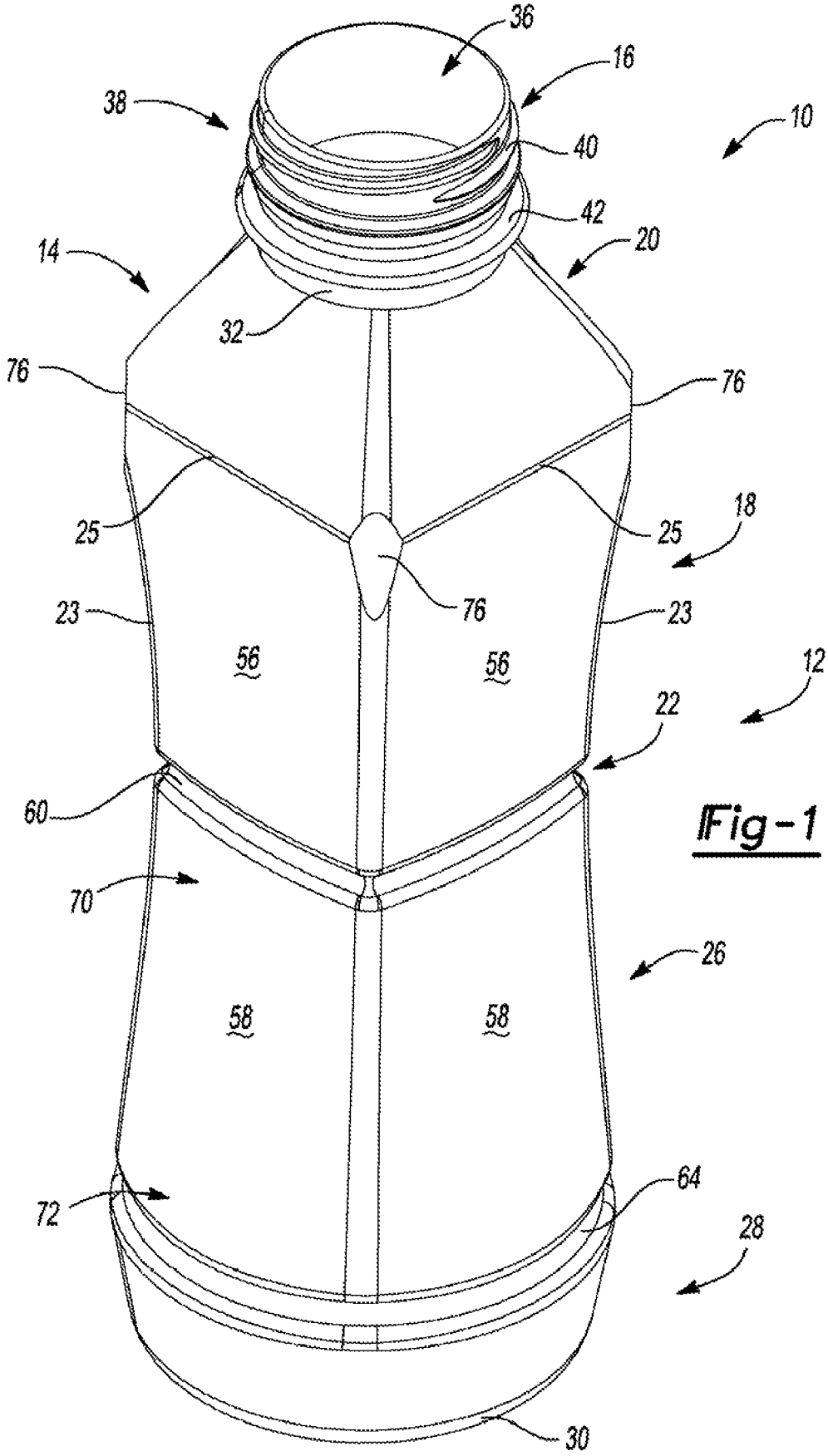
FIG. 1 is a detailed perspective view of a container constructed in accordance with the teachings of the present disclosure.

With initial reference to FIG. 1, a plastic container according to the present teachings is shown and generally identified at reference numeral 10. The plastic container 10 defines a body 12 and includes an upper portion 14 having a finish 16. Integrally formed with the finish 16 and extending downward therefrom is a shoulder region 20. The shoulder region 20 merges into and provides a transition between the finish 16 and a first vacuum absorbing region 18. The first vacuum absorbing region 18 merges into a waist region 22. The waist region 22 merges into a second vacuum absorbing region 26. The second vacuum absorbing region 26 can transition into a base portion 28 having a base 30. A neck 32 may also be included having an extremely short height, that is, becoming a short extension from the finish 16, or an elongated height, extending between the finish 16 and the shoulder region 20.

The plastic container 10 has been designed to retain a commodity. The commodity may be in any form such as a solid or liquid product. In one example, a liquid commodity may be introduced into the plastic container 10 during a thermal process, typically a hot-fill process, such as described above. In another example, the commodity may be introduced into the plastic container 10 under ambient temperatures.

The finish 16 of the plastic container 10 includes a portion defining an aperture or mouth 36, and a threaded region 38 having threads 40. The finish 16 can also define a support ring 42. The support ring 42 may be used to carry or orient a preform (the precursor to the plastic container 10, not illustrated) through and at various stages of manufacture. For example, the preform may be carried by the support ring 42, the support ring 42 may be used to aid in positioning the preform in the mold, or an end consumer may use the support ring 42 to carry the plastic container 10 once manufactured.

The mouth 36 allows the plastic container 10 to receive a commodity while the threaded region 38 provides a means for attachment of a similarly threaded closure or cap (not illustrated). Accordingly, the closure or cap (not illustrated) engages the finish 16 to preferably provide a hermetical seal of the plastic container 10. The closure or cap (not illustrated) is preferably of a plastic or metal material conventional to the closure industry and suitable for subsequent thermal processing, including high temperature pasteurization and retort.

Figure 3:
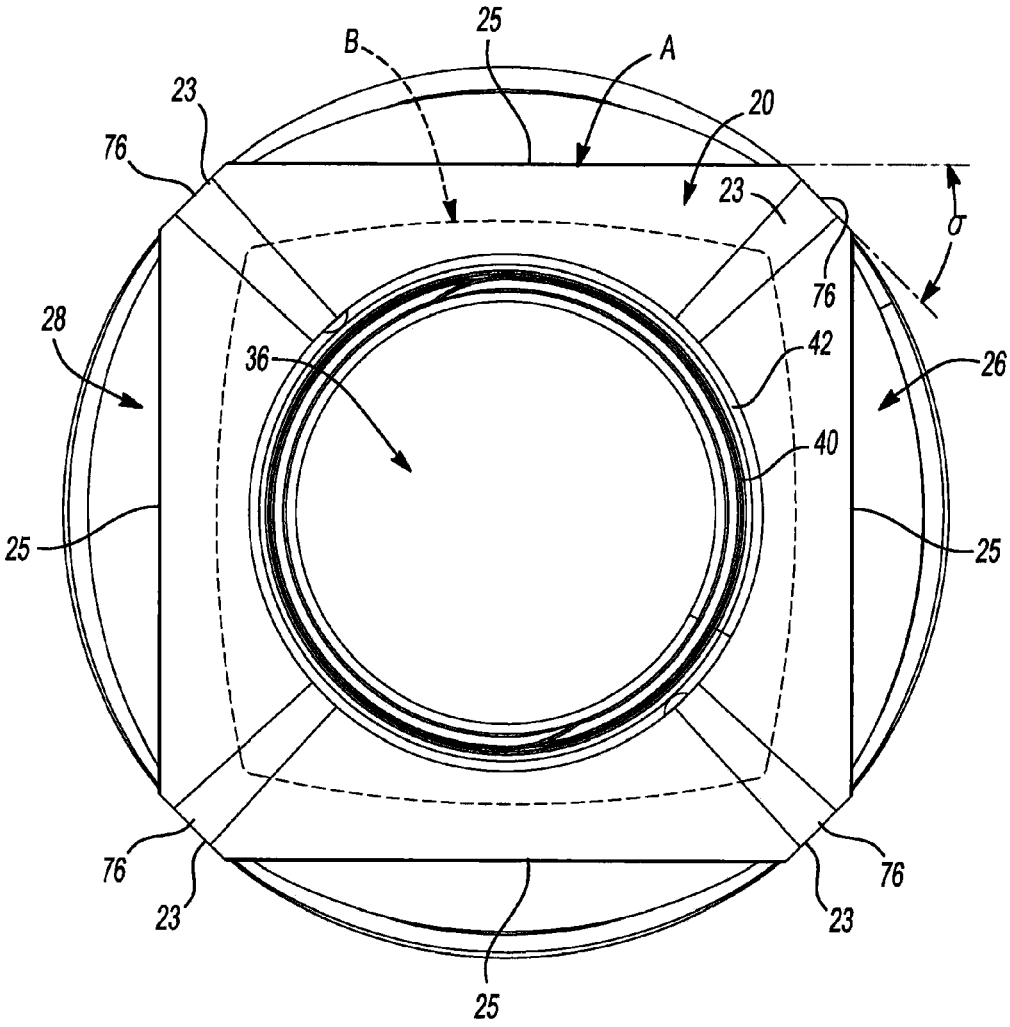
FIG. 3 is a top view of the container shown in FIG. 1.

The first vacuum absorbing region 18 extends from the shoulder region 20 to the waist region 22. A transition from the shoulder region 20 to the first vacuum absorbing region 18 is defined by a first section line A (FIG. 3). The first vacuum absorbing region 18 includes four vacuum panels 56 creating a generally rectangular horizontal cross-section of first vacuum absorbing region 18 throughout its vertical extent. In one example, the horizontal cross-section of the first vacuum absorbing region 18 can be a square cross-section. The waist region 22 has a cross-sectional profile that may be defined by a circumferential reinforcing rib 60. An innermost portion of the circumferential reinforcing rib 60 is defined by a second section line B (FIG. 3). The second section line B is offset inboard relative to the first section line A. The waist region 22 defines a transition between the first vacuum absorbing region 18 and the second vacuum absorbing region 26.

The second vacuum absorbing region 26 extends from the waist region 22 to the base portion 28. The second vacuum absorbing region 26 includes four vacuum panels 58. The second vacuum absorbing region 26 transitions from a first area 70 having a generally square horizontal cross-section adjacent to waist region 22 into a second area 72 having a generally circular horizontal cross-section adjacent to base portion 28. A transition between the second vacuum absorbing region 26 and the base portion 28 may be defined by a lower circumferential stiffening rib 64. The resultant plastic container 10 therefore provides an upper area (i.e. at the first vacuum absorbing region 18) having a generally square profile, provided by the vacuum panels 56 and a lower area (i.e. at the second vacuum absorbing region 26) that transitions into the cylindrical base 30. Such a combination can have favorable visual characteristics offered by the generally square profile of the upper area while also incorporating the desired cylindrical base profile that is favorable for manufacturing. A cylindrical base profile is desired for runability and line speed during manufacturing of the plastic container 10. Furthermore, the cylindrical base profile stabilizes the plastic container 10 during manufacturing, shipping and displaying on store shelves.

The vacuum panels 56 and 58 may be unframed and free of ribs and similar geometry. Planar transition surfaces 76 may be formed at intersections between the vacuum panels 56 and the shoulder region 20. The planar transition surfaces 76 may serve to reinforce the shoulder region 20 and the first vacuum absorbing region 18. The planar transition surfaces 76, the circumferential reinforcing rib 60, and the lower circumferential stiffening rib 64 combine to inhibit unwanted distortion of the plastic container 10 resulting from vacuum forces generated from the hot fill process.

Figure 2:
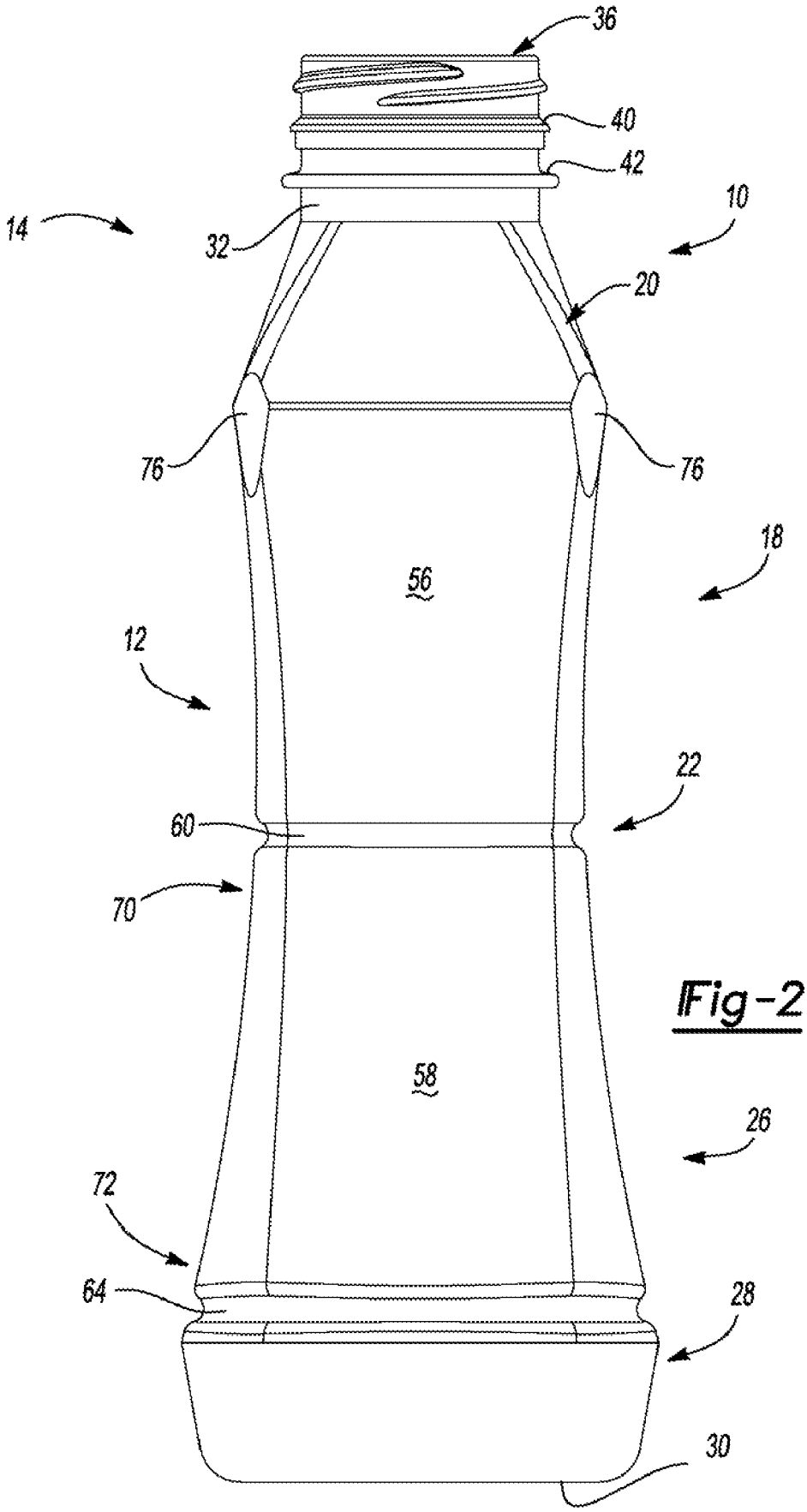
FIG. 2 is a side elevational view of the container shown in FIG. 1.

Therefore, with reference to FIGS. 1-3, what is disclosed above is a plastic container 10 that may employ an upper portion 14 having a mouth 36 defining an opening into the container 10, a shoulder region 20 extending from the upper portion 14, a first vacuum absorbing region 18 extending from the shoulder region 20, the first vacuum absorbing region 18 having a generally rectangular horizontal cross-section throughout a vertical extent thereof, a second vacuum absorbing region 26 extending from the first vacuum absorbing region 18, and a base portion 28 closing off an end of the container 10, the base portion 28 having a generally cylindrical cross-section. The first vacuum absorbing region 18 may have a generally square horizontal cross-section throughout its vertical extent with a first pair of opposing vacuum panels and a second pair of opposing vacuum panels. The opposing vacuum panels may be directly opposing or directly facing each other. More specifically, there may be no angle (i.e. zero angle) between directly opposing vacuum panels about a vertical edge 23 of the vacuum panels 56. In other words, opposing vacuum panels 56 may be skewed with respect to a vertical or longitudinal direction (i.e. length), and parallel with respect to a horizontal or transverse direction (i.e. width). A rectangular-like or square-like cross section provides a strong container 10, capable of withstanding top loads and other such forces without resulting in unwanted deformation. Such a square or rectangular construction is depicted in FIG. 3.

Continuing, the container 10 may further define planar transition surfaces 76 formed at intersections between the shoulder region 20 and the first vacuum panels 56. The plastic container 10 may further define a circumferential reinforcing rib 60 formed at a transition between the first and second vacuum absorbing regions 18, 26, in a region that is also referred to as the waist region 22. Similarly, the base portion 28 may define a lower circumferential stiffening rib 64 to provide strength to a lower area of the container 10. The strengthening ribs 60, 64 provide strength to the container 10 at their respective locations, not only to resist deformation while the container 10 is under a vacuum pressure, but also to provide localized strength around their respective locations to resist buckling, such as during vertical stacking of the containers in a warehouse, and to resist sidewall or body 12 denting. The second vacuum absorbing region 26 transitions between the first area 70 defined by a generally rectangular cross-sectional profile and the second area 72 defined by a generally circumferential cross-sectional profile.

Continuing, and with reference to FIGS. 1 and 3, between the shoulder region 20 and vacuum panels 56, a number of bends 25 exist to smooth the transition from the angled shoulder region 20 and the more vertical first vacuum absorbing region 18. The horizontal bends 25 provide strength to the transition area and contain the movement of the vacuum panels 56 when the container undergoes a vacuum pressure. The bends 25 define the horizontal transition edges, which may have a radius, between the shoulder region 20 and the first vacuum absorbing region 18, or more particularly, the vacuum panels 56. Because the bends 25 are essentially a long horizontal corner, the bends 25, all four in total between the shoulder region 20 and the vacuum panels 56, provide strength along the horizontal transition edges. What divides or separates the bends 25 from each other is a flat, planar transition surface 76 formed between each of the bends 25. More specifically, the planar transition surfaces 76 are located at the intersections between the shoulder region 20 and the vacuum panels 56 of the first vacuum absorbing region 18.

Regarding the first vacuum absorbing region 18, a first pair of directly opposing vacuum panels and a second pair of directly opposing vacuum panels form a rectangular or square shape in cross section, with the exception of the corners of the cross section which are flat. More specifically, the corners are comprised of flat, planar transition surfaces 76 that each form an angle, $\sigma$, of 45 degrees with its adjacent horizontal transition edge or bend 25 (FIG. 3).

Still yet, a plastic container 10 is disclosed with more specific relationships regarding distances between the vacuum panels 56 of the first vacuum absorbing region 18 and distances between the vacuum panels 58 of the second vacuum absorbing region 26. The first vacuum absorbing region 18 extends from the shoulder region 20 at and from the molded bend 25. The first vacuum absorbing region 18 may further define a first pair of opposing vacuum panels 56, 56, having a distance between the first pair that is greater along a top edge, such as at the bends 25, than along a bottom edge, such as at the reinforcing rib 60. A similar relationship exists with a second pair of opposing vacuum panels 56, 56 in the first vacuum absorbing region 18. The second vacuum absorbing region 26 may extend from the first vacuum absorbing region 18, or more specifically, from the reinforcing rib 60, which adjoins the first vacuum absorbing region 18 and the second vacuum absorbing region 26. At the bottom of the container 10 to close off an end of the container 10, the base portion 28 may have a generally circular or cylindrical cross-section.

The plastic container 10 may be configured such that the top edges, such as at bend 25, of the first pair of opposing vacuum panels 56, 56 and the second pair of opposing vacuum panels 56, 56 of the first vacuum absorbing region 18 are molded into and smoothly blend into the shoulder region 20. The bottom edges, such as at reinforcing rib 60, of the first pair of opposing vacuum panels 56, 56 and the second pair of opposing vacuum panels 56, 56 of the first vacuum absorbing region 18 are molded into and smoothly blend into the waist region 22. The second vacuum absorbing region 26 may further employ a first pair of opposing vacuum panels 58, 58 having a distance between the first pair that is shorter along top edges, such as at reinforcing rib 60, than along or proximate a bottom circumferential edge, such as at or proximate reinforcing or stiffening rib 64. A similar relationship exists with a second pair of opposing vacuum panels 58, 58 in the second vacuum absorbing region 26. The top edges, such as at reinforcing rib 60, of the first pair of opposing vacuum panels 58, 58 and the second pair of opposing vacuum panels 58, 58 of the second vacuum absorbing region 26 are molded into the waist region 22, and the bottom edge, such as at circumferential stiffening rib 64, of the first pair of opposing vacuum panels 58, 58 and the second pair of opposing vacuum panels 58, 58 of the second vacuum absorbing region 26 are molded into the base portion 28, which may have a generally circular or cylindrical cross-section.

The plastic container 10 may further be configured such that the first vacuum absorbing region 18 has a generally rectangular or square horizontal cross-section (FIG. 3) throughout some of or its entire vertical extent, while for strength, planar transition surfaces 76 may be formed at intersections between the shoulder region 20 and the first pair and the second pair of opposing vacuum panels 56 of the first vacuum absorbing region 18. The plastic container 10 may also define a circumferential stiffening rib 60 formed at the waist region 22 as a transition between the first and second vacuum absorbing regions 18, 26 and the base portion 28 may define a lower circumferential stiffening rib 64. The stiffening ribs 60, 64 provide strength to the container body 12 to prevent it from moving when vacuum panels 56, 58 move during product cooling. The second vacuum absorbing region 26 transitions between a first area 70 defined by a generally rectangular or square cross-sectional profile and a second area 72 defined by a generally circular or circumferential cross-sectional profile. The advantage of transitioning the second vacuum absorbing region 26 in such a way is that a circular bottom portion, adjacent the base portion 28 and on each side of the stiffening rib 64, may be maintained to facilitate holding of the container 10 during product filling and packaging.

While the above description constitutes the present disclosure, it will be appreciated that the disclosure is susceptible to modification, variation and change without departing from the proper scope and fair meaning of the accompanying claims.

What is claimed is:

1. A plastic container comprising:

an upper portion having a mouth defining an opening into said container;

a shoulder region extending from said upper portion;

a first vacuum absorbing region extending from said shoulder region, said first vacuum absorbing region further comprising:

a first pair of opposing vacuum panels having a distance between said first pair that is greater along a top edge than along a bottom edge; and a second pair of opposing vacuum panels having a distance between said second pair that is greater along a top edge than along a bottom edge;

a plurality of bends defining a plurality of straight, linear transition edges connecting the shoulder region and the first vacuum absorbing region, the plurality of bends providing strength along said transition edges;

a second vacuum absorbing region extending from said first vacuum absorbing region; and a base portion closing off an end of said container, said base portion having a generally cylindrical cross-section.

2. The plastic container of claim 1 wherein:

said top edges of said first pair of opposing vacuum panels and said second pair of opposing vacuum panels of said first vacuum absorbing region are molded into said shoulder region; and said bottom edges of said first pair of opposing vacuum panels and said second pair of opposing vacuum panels of said first vacuum absorbing region are molded into a waist region, said waist region located between said first vacuum absorbing region and said second vacuum absorbing region.

3. The plastic container of claim 2 wherein said second vacuum absorbing region further comprises:

a first pair of opposing vacuum panels having a distance between said first pair that is shorter along a top edge than along a bottom circumferential edge; and a second pair of opposing vacuum panels having a distance between said second pair that is shorter along a top edge than along a bottom circumferential edge.

4. The plastic container of claim 3 wherein:

said top edges of said first pair of opposing vacuum panels and said second pair of opposing vacuum panels of said second vacuum absorbing region are molded into said waist region; and said bottom edges of said first pair of opposing vacuum panels and said second pair of opposing vacuum panels of said second vacuum absorbing region are molded into said base portion having a generally cylindrical cross-section.

5. The plastic container of claim 4 wherein said first vacuum absorbing region has a generally square horizontal cross-section throughout a vertical extent.

6. The plastic container of claim 1 wherein said container further defines a plurality of planar transition surfaces formed between each of said bends and at intersections between said shoulder region and said first pair and said second pair of opposing vacuum panels of said first vacuum absorbing region.

7. The plastic container of claim 6 wherein:

said plastic container defines a circumferential reinforcing rib formed at said waist region as a transition between said first and second vacuum absorbing regions;

said base portion defines a lower circumferential stiffening rib; and said second vacuum absorbing region transitions between a first area defined by a generally rectangular cross-sectional profile and a second area defined by a generally circumferential cross-sectional profile.

8. A plastic container comprising:

an upper portion having a mouth defining an opening into said container;

a shoulder region extending from said upper portion;

a first vacuum absorbing region extending from said shoulder region and having a generally square horizontal cross-section entirely throughout its vertical extent, said first vacuum absorbing region further comprising:

a first pair of opposing vacuum panels having a distance between said first pair that is greater along a top edge than along a bottom edge; and a second pair of opposing vacuum panels having a distance between said second pair that is greater along a top edge than along a bottom edge;

a plurality of bends defining a plurality of straight, linear transition edges connecting the shoulder region and the first vacuum absorbing region, the plurality of bends providing strength along said transition edges;

a second vacuum absorbing region extending from said first vacuum absorbing region, said second vacuum absorbing region transitioning from a first area defined by a generally square cross-sectional profile to a second area defined by a generally cylindrical cross-sectional profile; and a base portion closing off an end of said container, said base portion having a generally cylindrical cross-section.

9. The plastic container of claim 8, further comprising:

a waist region located between said first vacuum absorbing region and said second vacuum absorbing region, wherein:

said top edges of said first pair of opposing vacuum panels and said second pair of opposing vacuum panels of said first vacuum absorbing region are molded into said shoulder region; and said bottom edges of said first pair of opposing vacuum panels and said second pair of opposing vacuum panels of said first vacuum absorbing region are molded into said waist region.

10. The plastic container of claim 9 wherein said second vacuum absorbing region further comprises:

a first pair of opposing vacuum panels having a distance between said first pair that is shorter along a top edge than along a bottom circumferential edge; and a second pair of opposing vacuum panels having a distance between said second pair that is shorter along a top edge than along a bottom circumferential edge.

11. The plastic container of claim 10 wherein:

said top edges of said first pair of opposing vacuum panels and said second pair of opposing vacuum panels of said second vacuum absorbing region are molded into said waist region; and said bottom edges of said first pair of opposing vacuum panels and said second pair of opposing vacuum panels of said second vacuum absorbing region are molded into said base portion having a generally cylindrical cross-section.

12. The plastic container of claim 8 wherein said container further defines a plurality of planar transition surfaces formed at intersections between each of said bends and said shoulder region and said first vacuum absorbing region.

13. The plastic container of claim 12 wherein said plastic container defines a circumferential reinforcing rib formed between each of and directly connecting each of said first and second vacuum absorbing regions.

14. The plastic container of claim 13 wherein said base portion defines a lower circumferential stiffening rib.

15. A plastic container comprising:

an upper portion having a mouth defining an opening into said container;

a shoulder region extending from said upper portion;

a first vacuum absorbing region extending from said shoulder region, said first vacuum absorbing region having a generally rectangular horizontal cross-section throughout a vertical extent thereof;

a plurality of bends defining a plurality of horizontal transition edges between the shoulder region and the first vacuum absorbing region, the plurality of bends providing strength along said horizontal transition edges;

a plurality of flat, planar transition surfaces formed between each of said bends and at intersections between said shoulder region and said first vacuum absorbing region;

a second vacuum absorbing region extending from said first vacuum absorbing region, said second vacuum absorbing region transitioning between a first area defined by a generally square cross-sectional profile and a second area defined by a generally cylindrical cross-sectional profile; and a base portion closing off an end of said container, said base portion having a generally cylindrical cross-section.

16. The plastic container of claim 15, wherein said first vacuum absorbing region comprises a first pair of directly opposing vacuum panels and a second pair of directly opposing vacuum panels; and each of said flat, planar transition surfaces is at an adjoining angle of 45 degrees adjacent said transition edges.

17. The plastic container of claim 16, further comprising:

a horizontal reinforcing rib positioned between said first vacuum absorbing region and said second vacuum absorbing region.

* * * * *